US006432165B1

(12) United States Patent
Dittrich et al.

(10) Patent No.: US 6,432,165 B1
(45) Date of Patent: Aug. 13, 2002

(54) METHOD FOR INJECTING GASES INTO A METALLURGICAL TANK

(75) Inventors: Rainer Dittrich; Horst-Dieter Schöler, both of Duisburg; Andreas Ploch, Dinslaken; Manfred Zeimes, Hilden, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/555,546

(22) PCT Filed: Nov. 24, 1998

(86) PCT No.: PCT/DE98/03512

§ 371 (c)(1),
(2), (4) Date: Aug. 15, 2000

(87) PCT Pub. No.: WO99/29915

PCT Pub. Date: Jun. 17, 1999

(30) Foreign Application Priority Data

Dec. 4, 1997 (DE) ..... 197 55 876

(51) Int. Cl.[7] ..... C21C 7/072
(52) U.S. Cl. ..... 75/529; 266/44
(58) Field of Search ..... 75/529; 266/44

(56) References Cited

U.S. PATENT DOCUMENTS 4,730,784 A * 3/1988 Bock et al. ..... 239/416.4
5,954,855 A * 9/1999 Gitman et al. ..... 75/10.42

FOREIGN PATENT DOCUMENTS

| | | | |
|---|---|---|---|
| DE | 41 21 266 | | 10/1993 |
| DE | 42 21 266 C | | 10/1993 |
| DE | 44 42 362 C | | 4/1996 |
| DE | 44 42 362 | | 4/1998 |
| DE | 29 807 145 | | 7/1998 |
| DE | 029807145 U1 | * | 7/1998 |
| EP | 000789083 A1 | * | 8/1997 |
| FR | 2644558 | * | 3/1989 |
| WO | WO8400176 | * | 1/1984 |

OTHER PUBLICATIONS

Electric Furnace Steelmaking, vol. 1: Design, Operation, and Practice. 1962, pp. 266–267.*

* cited by examiner

*Primary Examiner*—Roy King
*Assistant Examiner*—Tima McGuthry-Banks
(74) *Attorney, Agent, or Firm*—Cohen, Pontani, Lieberman & Pavane

(57) ABSTRACT

A blowing lance for treating molten metals which are situated in vacuum-treatment vessels, in particular steel in RH vessels, having a central pipe and an encasing pipe which is arranged coaxially with respect to the central pipe and can be cooled by a cooling medium. The central pipe and the encasing pipe are connected to supply lines, which in turn can be connected to an oxygen station, a fuel-gas station and an inert-gas station and to a solids-feed device. In this lance, the cooled encasing pipe is arranged at a distance from the central pipe over its entire length. The free annular area ($A_R$) between the two pipes satisfying the following statement $$A_R = 0.8 \text{ to } 1.2 \times A_Z$$

where $A_Z$=free cross-sectional area of the central pipe. The end of the central pipe is designed in the form of a Laval nozzle. The nozzle opening of the central pipe is being arranged at a distance (a) inside the encasing tube, where a=0.5 to 0.8×d where d=clear diameter of the central pipe.

7 Claims, 3 Drawing Sheets

METHOD FOR INJECTING GASES INTO A METALLURGICAL TANK

BACKGROUND OF THE INVENTION

1. Field of the Invention

The invention relates to a method for blowing combustible, optionally solids-laden gases into the free space above a molten metal located in a metallurgical vessel, in particular molten steel in an RH vessel which is under vacuum, by means of a cooled lance. The invention further relates to a blowing lance for carrying out the method.

2. Discussion of Prior Art

WO 97/08348 has disclosed a method for refining metals in a vacuum vessel, in which a lance is used having a central pipe which is surrounded by an encasing pipe which is arranged coaxially. In this case, the central pipe is in the form of a straight cylinder and extends all the way to the end of the encasing pipe. The encasing pipe itself diverges conically in its end region.

Furthermore, WO 96/16190 has disclosed a multifunctional lance which can be used for the vacuum treatment of steel in an RH vessel [vacuum vessel for removing oxygen from steel] and which allows the processes of oxygen blowing with and without solids and the generation of a combustion flame independently of one another. This multifunctional lance has a displaceable central pipe which is in the form of a straight cylinder and is arranged inside an encasing pipe, which has an end which widens conically, coaxially with respect to this encasing pipe.

Particularly during combustion, operating with these known lances causes considerable noise pollution. A further drawback is the relatively complicated design of the lance.

SUMMARY OF THE INVENTION

The invention is based on the object of providing a method and a suitable blowing lance which, by simple design means, considerably reduces the noise emissions without lowering the individual introduction rates of the media, in particular in the combustion phase.

According to the invention, the first gas flow, which is guided through the central pipe, runs in such a way that, on leaving the end of the central pipe, during re-expansion it comes into contact with the. second gas flow which surrounds it and is guided through the encasing pipe. In the process, the first gas flow is reflected by the second gas flow and/or the inner wall of the encasing pipe of the lance and, as a result, is bundled outside the lance, downstream thereof. Surprisingly, it has emerged that this reflection has scarcely any adverse effect on the output rate, yet the subsequent intensive bundling considerably reduces the noise.

The blowing lance used in this method has a cooled encasing pipe, in which a central pipe is coaxially arranged, the end of which is designed in the form of a Laval nozzle. The nozzle opening of the central pipe ends inside the encasing pipe, specifically at a distance of a=0.5 to 0.8×d, where d is the clear diameter of the central pipe.

In one embodiment, the first gas flow, which is guided through the central pipe at a pressure of 4 to 6 bar, is set in vibration at the end of the central pipe. This gas which has been set in vibration can be securely bundled even at high gas speeds. For this purpose, a chamber which serves as a vibration generator is provided in that part of the central pipe which is in the form of a Laval nozzle. This chamber is of annular design and substantially follows the inner wall of the Laval nozzle, or alternately is of entirely cylindrical design.

In an advantageous embodiment, it is proposed for the central pipe to be moved axially in a defined manner, in order to keep the noise to a minimum level according to the quantities of gas currently being blown.

Furthermore, it is proposed for the encasing pipe at its end to converge conically, at an angle $\alpha$ of 1 to 10°, over an area corresponding to the distance a, in the direction of gas flow. This embodiment helps to bundle together the first gas flow which emerges from the central pipe.

BRIEF DESCRIPTION OF THE DRAWINGS

One example of the invention is illustrated in the appended drawing, in which.

DETAILED DESCRIPTION OF THE PREFERRED EMBODIMENTS

Figure 1:
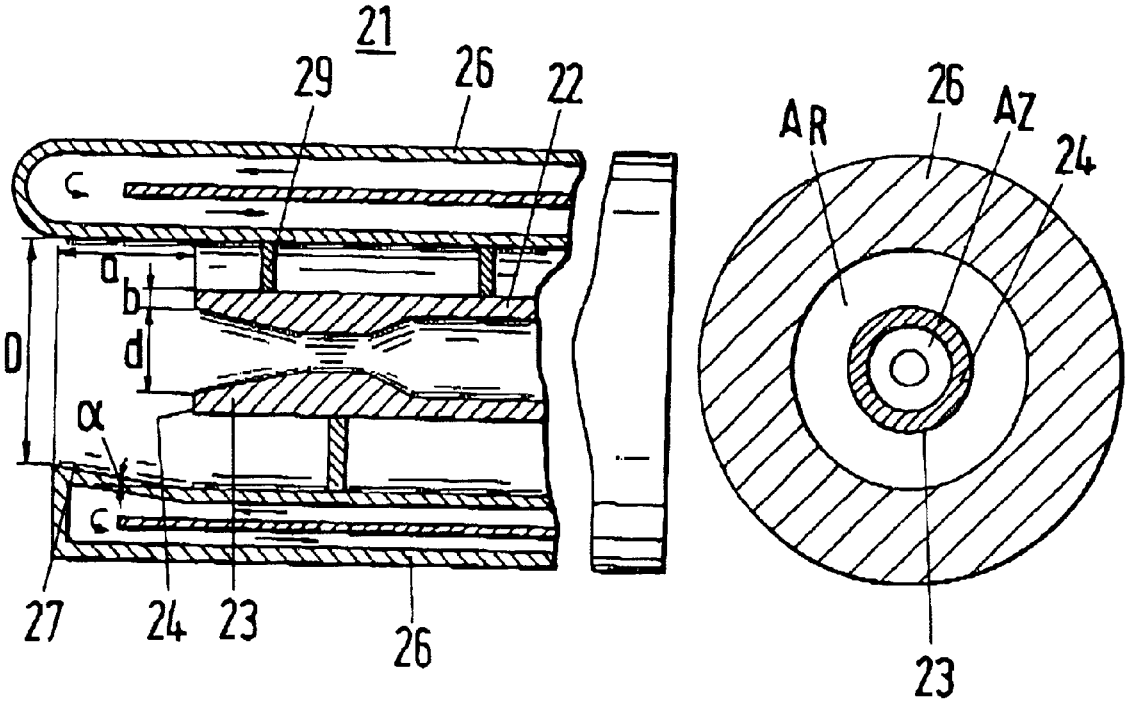
FIG. 1 shows the end region of the blowing lance.

FIG. 1 shows a blowing lance 21 with a central pipe 22 which is surrounded by a water-cooled encasing pipe 26. The central pipe 22 is mounted centrally inside the encasing pipe 26 by means of spacer elements 29.

The end 23 of the central pipe 22 is designed in the form of a Laval nozzle, with the diameter d. The nozzle opening 24 itself has a wall thickness of b>5 mm, ensuring that the end is sufficiently strong.

The central pipe 22 is arranged in such a way inside the encasing pipe 26 that the nozzle opening 24 is at a distance a of from 0.5 to 0.8×d from the nozzle opening of the encasing pipe 26.

In the bottom part of the picture, the inner wall 27 of the encasing pipe 26 is designed in such a manner that the end converges conically at an angle $\alpha$=1 to 10° over the region corresponding to distance a, in the direction of gas flow.

FIG. 1*a* shows a section through the blowing lance and illustrates the free annular area $A_R$ between the encasing pipe 26 and the central pipe 22, the size of which is $A_R$=0.8 to 1.2×$A_Z$, where $A_Z$ is the clear cross-sectional area of the central pipe.

Figure 2:
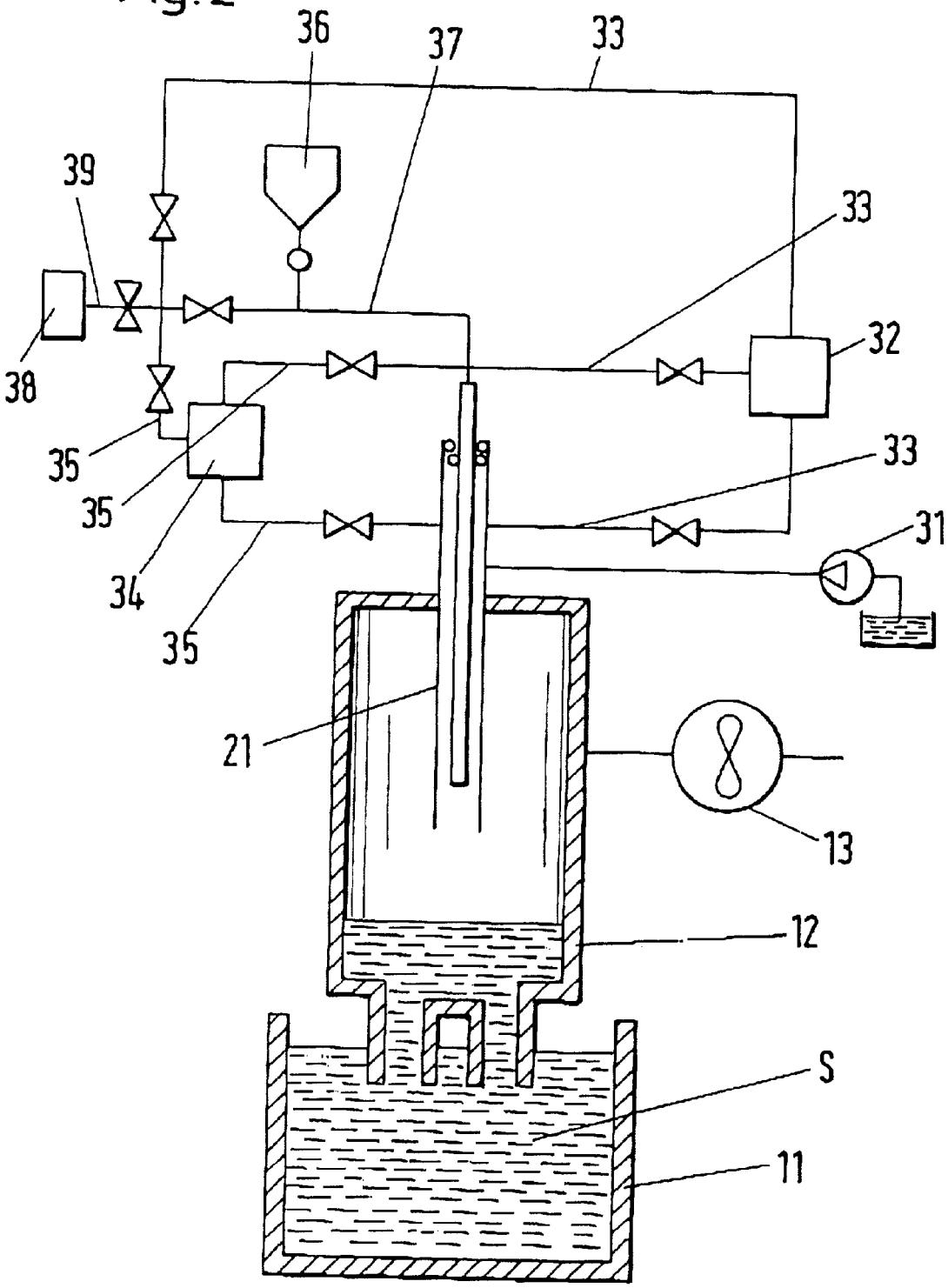
FIG. 2 shows the arrangement of the vacuum treatment installation.

FIG. 2 shows a metallurgical vessel 11 which is filled with molten material S. An RH vessel 12, which is connected to a vacuum installation 13 and into which a blowing lance 21 projects, projects into the molten material S.

The blowing lance 21 is connected to various media supplies, specifically to a cooling medium 31, to an oxygen supply 32 via oxygen lines 33, to a fuel-gas supply 34 (such as natural gas) via fuel-gas lines 35, to a solids supply 36 (such as coal dust) via a solids line 37, and to an inert-gas supply 38 via an inert-gas line 39. The individual lines 33, 35, 37 and 39 can be blocked by means of suitable valves and fittings.

Figure 3:
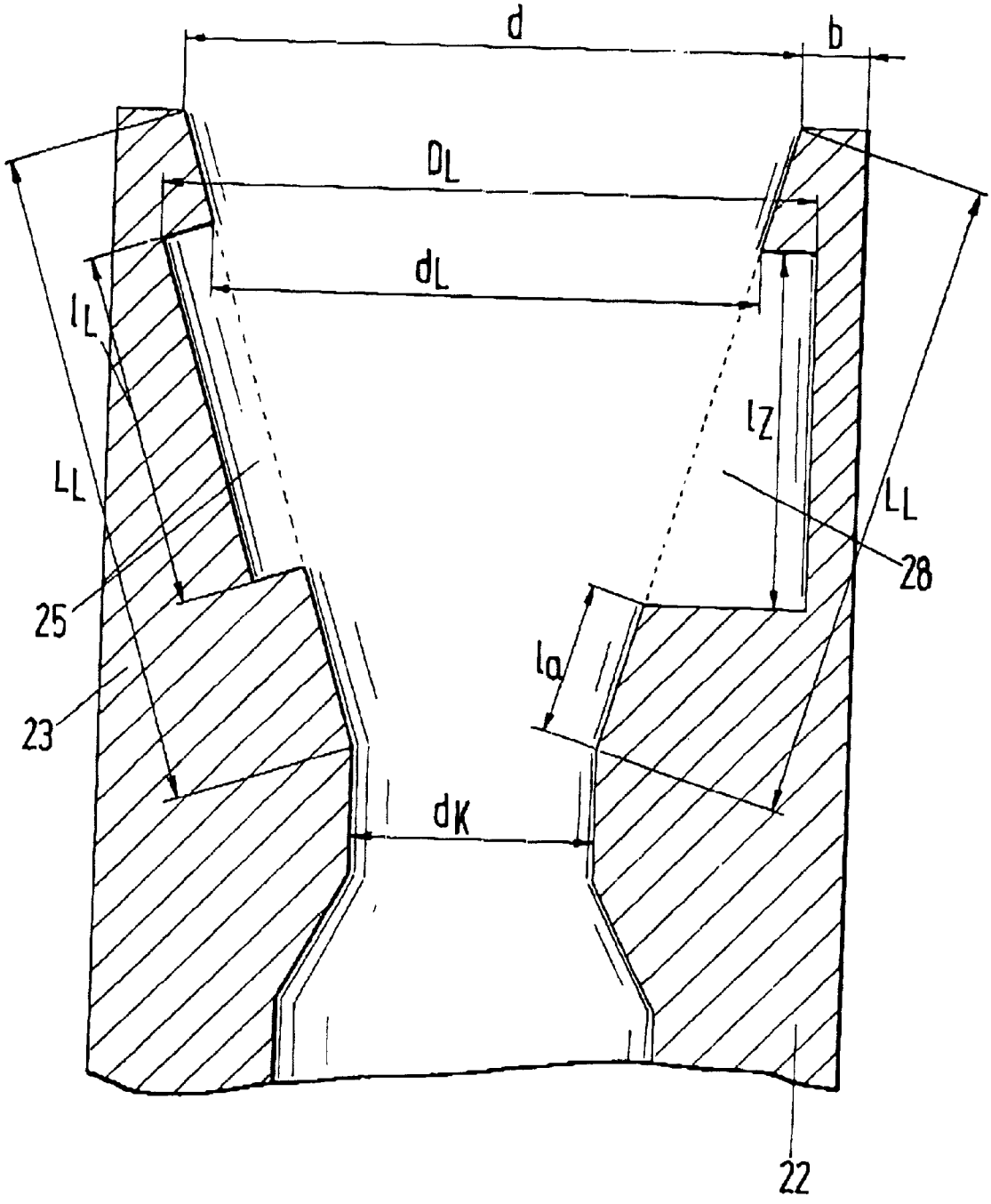
FIG. 3 shows the central pipe as a vibration generator.

FIG. 3 shows the end 23 of the central pipe 22 having the chambers 25, 28 as vibration generators. In this case, the diameter of the end of the central pipe 22 is d and the wall thickness thereof is b. The length of the Laval nozzle is denoted by $L_L$, and the critical diameter is denoted by $d_K$. Beginning from the critical diameter $d_K$, in the direction of gas flow, the length of the Laval nozzle is denoted by $l_a$.

The left-hand side of FIG. 3 shows an annular chamber 25 which is in the form of a Laval nozzle and is of the length $l_L$ and diameter $D_L$ at the end of the chamber 25, as seen in the direction of flow. Over the length of the annular chamber

25, which is in the form of a Laval nozzle, the ratio of the diameter $D_L$ to the virtual diameter $d_L$ of the Laval nozzle is constant.

The right-hand side of the figure shows a cylindrical chamber 28 of a length $L_Z$ and with a constant diameter $D_L$. This chamber 28 is at a distance $l_a$ from the critical diameter $d_K$ of the end 23 which is in the form of a Laval nozzle.

If fossil fuel gas is guided through the central pipe and oxygen through the annular chamber or, oxygen through the central pipe and fossil fuel gas through the annular chamber, the oxygen and fuel gas are set in approximately stoichiometric ratios and the pressure $p_B$ of the fuel gas and $p_o$ of the oxygen are set $p_B/p_0$=1.4 to 1.8/1.

When oxygen is guided through the central pipe and an inert gas is guided through the annular chamber, given an amount of blown oxygen of $m_0$=3,000 to 4,000 $m^3/h$ (s.t.p.), quantitative ratios of the quantity of oxygen $m_0$ and the quantity of inert gas $m_G$ are set so that $m_o/m_G$=20/1 to 50/1.

The invention is not limited by the embodiments described above which are presented as examples only but can be modified in various ways within the scope of protection defined by the appended patent claims.

What is claimed is:

1. Method for blowing combustible gases into a free space above a molten metal located in a metallurgical vessel which is under vacuum, by means of a cooled lance, comprising the steps of:

b) adding solid particles to the gas according to a desired procedure;

c) guiding a second gas flow out to beyond the end of the central pipe via an annular chamber arranged coaxially with respect to the central pipe so that the second gas flow surrounds the first gas flow;

d) on leaving the end of the central pipe which is in the form of a Laval nozzle, the first gas flow re-expands and comes into contact with the surrounding second gas flow, is deflected by at least one of the second gas flow and an inner wall of an encasing pipe of the lance, which encasing pipe converges conically in the direction of gas flow, whereby the first gas flow is bundled outside the lance, downstream thereof, the first gas flow guided through the central pipe being a fossil-fuel gas and the second gas flow guided through the annular chamber being oxygen, the process including setting the fuel gas and the oxygen in approximately stoichiometric ratios and setting dynamic pressures $p_B/p_o$at 1.4 to 1.8/1 where $p_B$=pressure of the fuel gas, and $p_o$=pressure of the oxygen.

2. A method according to claim 1, wherein the first gas flow is natural gas.

3. A method according to claim 1, including adding solids to the fuel gas.

4. A method according to claim 3, wherein the step of adding solids to the fuel gas includes adding coal dust to the fuel gas.

5. A method according to claim 1, further including setting the first gas flow, which is guided through the central pipe at a pressure (p) where p=4 to 6 bar, in vibration at the end of the central pipe.

6. Method for blowing combustible gases into a free space above a molten metal located in a metallurgical vessel which is under vacuum, by means of a cooled lance, comprising the steps of a) guiding a first gas flow through a central pipe having an end designed in the form of a Laval nozzle;

b) adding solid particles to the gas according to a desired procedure;

c) guiding a second gas flow out to beyond the end of the central pipe via an annular chamber arranged coaxially with respect to the central pipe so that the second gas flow surrounds the first gas flow;

d) on leaving the end of the central pipe which is in the form of a Laval nozzle, the first gas flow re-expands and comes into contact with the surrounding second gas flow, is deflected by at least one of the second gas flow and an inner wall of an encasing pipe of the lance, which encasing pipe converges conically in the direction of gas flow, whereby the first gas flow is bundled outside the lance, downstream thereof, the first gas flow, which is guided through the central pipe, being oxygen and the second gas flow, which is guided through the annular chamber, being a fossil-fuel gas, the process including setting the oxygen and the fuel gas in approximately stoichiometric ratios and setting pressures $p_B/p_o$ at 1.4 to 1.8/1, where $p_B$=pressure of the fuel gas, and $p_o$=pressure of the oxygen.

7. Method for blowing combustible gases into a free space above a molten metal located in a metallurgical vessel which is under vacuum, by means of a cooled lance, comprising the steps of a) guiding a first gas flow through a central pipe having an end designed in the form of a Laval nozzle;

b) adding solid particles to the gas according to a desired procedure;

c) guiding a second gas flow out to beyond the end of the central pipe via an annular chamber arranged coaxially with respect to the central pipe so that the second gas flow surrounds the first gas flow;

d) on leaving the end of the central pipe which is in the form of a Laval nozzle, the first gas flow re-expands and comes into contact with the surrounding second gas flow, is deflected by at least one of the second gas flow and an inner wall of an encasing pipe of the lance, which encasing pipe converges conically in the direction of gas flow, whereby the first gas flow is bundled outside the lance, downstream thereof, the first gas flow, which is guided through the central pipe, being oxygen, and the second gas flow guided through the annular chamber being inert gas, given an amount of blown oxygen of $m_0$=3,000 to 4,000 $m^3/h$ (s.t.p.), quantative ratios $m_0/m_G$ are set to 20/1 to 50/1 where $m_0$=quantity of oxygen, and $m_G$=quantity of insert gas.

* * * * *

UNITED STATES PATENT AND TRADEMARK OFFICE

CERTIFICATE OF CORRECTION

PATENT NO. : 6,432,165 B1
DATED : August 13, 2002
INVENTOR(S) : Rainer Dittrich

It is certified that error appears in the above-identified patent and that said Letters Patent is hereby corrected as shown below:

Title page,
Item [73], should read as follows:

-- SMS Demag AG
Düsseldorf, Germany (DE)
and
Thyssen Krupp Stahl AG
Düsseldorf, Germany (DE)

Signed and Sealed this

Twenty-first Day of January, 2003

JAMES E. ROGAN
*Director of the United States Patent and Trademark Office*